United States Patent [19]

Pitzer et al.

[11] 4,196,089

[45] Apr. 1, 1980

[54] PREPARATION OF OVERBASED MAGNESIUM SULFURIZED PHENATES

[75] Inventors: Charles L. Pitzer, North Muskegon, Mich.; Norman Jacobson, Oak Ridge, N.J.

[73] Assignee: Witco Chemical Corporation, New York, N.Y.

[21] Appl. No.: 917,215

[22] Filed: Jun. 20, 1978

[51] Int. Cl.[2] ..... C10M 1/40; C07C 37/00

[52] U.S. Cl. ..... 252/42.7; 568/780

[58] Field of Search ..... 252/42.7, 18, 33.4, 568/780; 260/608, 609

[56] References Cited

U.S. PATENT DOCUMENTS

| | | | |
|---|---|---|---|
| 3,718,589 | 2/1973 | Roger | 252/33.4 |
| 3,772,198 | 11/1973 | Cease et al. | 252/32.7 C |
| 3,801,507 | 4/1974 | Hendrickson | 252/42.7 |
| 4,049,560 | 9/1977 | Dominey | 252/42.7 |

*Primary Examiner*—Werren B. Lone

*Attorney, Agent, or Firm*—Albert L. Gazzola; Morton Friedman

[57] ABSTRACT

Preparation of overbased magnesium sulfurized phenates having total base members in the range of about 200 to about 275 by a two-stage procedure, the first stage of which involves dissolving a sulfurized oil-soluble aliphatic hydrocarbyl-substituted phenol, particularly a $C_6$–$C_{30}$ alkyl phenol, in certain types of high boiling organic polar solvents, exemplified particularly by methyl "Cellosolve," and admixing therewith magnesium oxide in an amount such that, upon refluxing the mixture, a fully neutralized sulfurized alkyl phenol results; and wherein, in the second stage of said procedure, the composition produced in the first stage of the procedure is overbased by admixing therewith a magnesium alkoxide carbonate complex in an amount such as to produce the final overbased magnesium sulfurized phenate compositions having the aforesaid total base number.

8 Claims, No Drawings

PREPARATION OF OVERBASED MAGNESIUM SULFURIZED PHENATES

Our invention is directed to a new and useful two-stage process for preparing overbased magnesium sulfurized phenates, more specifically, magnesium sulfurized aliphatic hydrocarbylsubstituted phenol compositions, which are characterized by a total base number (TBN) in the range of about 200 to about 275. Such overbased compositions have excellent utility as detergents and for other purposes, particularly for utilization in lubricating oils for use in diesel engines and internal combustion engines, and they possess, among other properties, corrosion inhibiting and antioxidant properties, the ability to reduce engine wear and to inhibit formation of undesirable and harmful deposits on engine parts.

The preparation of overbased magnesium sulfurized phenates having various ranges of total base numbers, including, for instance, those in the range of about 200 to about 275, has long been known to the art and is disclosed in many U.S. patents illustrative of which are Nos. 2,895,913; 3,388,063; 3,718,589; 3,746,698; 3,801,507; and 4,049,560. Among the known methods of preparation, as disclosed in the aforesaid U.S. Pat. No. 3,746,698, has been, broadly speaking, to react a previously prepared sulfurized oil-soluble aliphatic hydrocarbyl-substituted phenol, for example, a sulfurized nonyl phenol, with an alkanol solution of a magnesium alkoxy alkoxide-carbonate complex, said complex being commonly referred to as a "magnesium intermediate." The magnesium intermediate is conventionally prepared by reacting magnesium metal with an alkoxy alkanol, which can be represented for the formula $R—O—CH_2—CH_2—OH$, where R is a $C_1$ to $C_6$ alkyl group, or with a monoalkyl ether of a glycol in which the alkyl group contains from 1 to 6 carbon atoms, particularly the monomethyl ether of ethylene glycol (methyl "Cellosolve"), whereby to form a magnesium alkoxy alkoxide, and then reacting said alkoxy alkoxide with carbon dioxide to form an oil-soluble magnesium alkoxy alkoxide-carbonate complex. Certain of such complexes are generally represented for the formula $$Mg(OCH_2CH_2OR)_{2-x}\ (O-\overset{\overset{\displaystyle O}{\|}}{C}-OCH_2-CH_2-OR)_x$$

where R is selected from the group consisting of (1) $C_1$ to $C_6$ alkyl groups and (2) an organic radical having the formula $$-\underset{\underset{\displaystyle H}{|}}{\overset{\overset{\displaystyle H}{|}}{C}}-\underset{\underset{\displaystyle H}{|}}{\overset{\overset{\displaystyle H}{|}}{C}}-O-R^1$$

where $R^1$ is a $C_1$ to $C_4$ alkyl group and where x is a number varying from 0.5 to 1.5, preferably from 0.85 to 1.15. The alkoxy alkanol solution of the magnesium alkoxy alkoxide-carbonate complexes may contain from about 1 to 11 wt.%. of Mg but, preferably, from about 4 to 10 wt.%.

Their preparation, as indicated above, is well known to the art and is disclosed, for instance, in such U.S. Pat. Nos. as 3,150,088; 3,150,089; 3,718,589 and 3,772,198, the disclosures of said patents in relation to said "magnesium intermediate" and methods of preparation thereof being incorporated herein by reference.

In the preparation of overbased magnesium sulfurized phenates, it has been common practice to admix sulfurized oil-soluble aliphatic hydrocarbyl-substituted phenols, such as sulfurized nonyl phenols, with the aforementioned magnesium intermediate to effect both neutralization and overbasing of the sulfurized aliphatic hydrocarbyl-substituted phenols. This procedure, however, has the serious disadvantage of being quite expensive because of the cost involved in the necessity for the use of magnesium metal in the preparation of the aforesaid magnesium intermediate.

We have observed that, generally speaking, when using the aforesaid known process for the preparation of the overbased magnesium sulfurized phenates, approximately one-third of the total base number of, say, such an overbased phenate having a base number in the range of about 200 to about 275, results from the neutralization of the relatively weakly acid sulfurized oil-soluble aliphatic hydrocarbyl-substituted phenols by the magnesium intermediate, and the balance of the total base number of said overbased phenate results from or is contributed by or is attributable to the balance of the magnesium intermediate used in the process of preparing the overbased magnesium sulfurized phenates having base numbers in the range of the order of about 200 to about 275.

If, in place of the magnesium intermediate, one seeks to utilize the much less expensive magnesium oxide to produce overbased magnesium sulfurized phenates by reaction with sulfurized oil-soluble aliphatic hydrocarbyl-substituted phenols to attempt to produce such overbased magnesium sulfurized phenates having base numbers in the range of about 200 to about 275, such attempts fail. Apart from certain procedural difficulties which arise, one cannot, by such attempted procedures, produce overbased phenates having total base numbers remotely close to even about 200. Furthermore, efforts by us to produce overhead magnesium sulfurized phenates having base numbers in the range of about 200 to about 275 by reacting sulfurized oil-soluble aliphatic hydrocarbyl-substituted phenols with magnesium oxide coupled with carbonation with $CO_2$, even at quite high temperatures, have not been successful.

In accordance with our present invention, it has been found, surprisingly, that it is possible to produce highly satisfactory overbased magnesium sulfurized phenates having base numbers in the range of about 200 and 275, particularly about 250 to about 260, by a two-stage process which involves the use of magnesium oxide and which is distinctly more economical than the aforementioned process in which a magnesium intermediate is used to effect the neutralization and overbasing of the relatively weakly acidic sulfurized oil-soluble aliphatic hydrocarbyl-substituted phenols.

We have discovered that, if a sulfurized oil-soluble aliphatic hydrocarbyl-substituted phenol (or mixtures of sulfurized oil-soluble aliphatic hydrocarbyl-substituted phenols) is reacted, in what we characterize as the first stage of our two-stage process, with magnesium oxide in certain proportions and in the presence of certain high-boiling organic polar solvents, as described below, and at somewhat elevated temperatures, neutralization of the acidic sulfurized aliphatic hydrocarbyl-substituted phenols is simply and rapidly effected. The resulting neutralized product, namely, the magnesium sulfurized aliphatic hydrocarbyl-substituted phenol, in solution, in said high-boiling organic polar solvent, is then reacted, in the second stage of our process, with an amount of the above-described magnesium intermediate to produce a final overbased magnesium sulfurized phenate having a base number in the range of about 200 to about 275, said amount of said magnesium intermediate utilized being very substantially less than was required to be employed in accordance with known prior art procedures described above wherein the magnesium intermediate was used to effect the neutralization and the overbasing of the sulfurized oil-soluble aliphatic hydrocarbyl-substituted phenols, thereby producing marked reductions in cost, particularly when measured in terms of large scale volumes of production of the overbased magnesium sulfurized phenates. It is to be understood that we do not claim any patentable novelty in the preparation of overbased magnesium sulfurized phenates or alkyl phenates broadly by a two-stage process in which a neutral sulfurized alkyl phenate is prepared in a first step and the overbased sulfurized alkyl phenate is then prepared in a second step. Such procedure is generally referred to in the aforementioned U.S. Pat. No. 3,746,698. In addition to the disclosures in said last-mentioned patent, the aforementioned U.S. Pat. Nos. 3,801,507 and 4,049,560 disclose two-stage or what may be considered two-stage processes. The particular process of our present invention is, however, definitely distinguished from and is not disclosed nor suggested by the processes of the foregoing patents.

Considering, further, the process of our present invention, it may be pointed out that the particular high boiling organic polar solvent utilized in the first stage of the process of the present invention plays an important role in obtaining optimum results of the practice of our invention since the solvation effect, coupled with the temperature at which the first stage of the process is carried out, play an important role in regard to the full utilization of the magnesium oxide in the neutralization step of the sulfurized hydrocarbyl-substituted phenols.

It has been found that the high boiling organic polar solvents which are especially useful in the practice of our invention are lower ($C_1$–$C_6$) alkyl monoethers of such lower glycols as ethylene glycol, diethylene glycol and propylene glycol, exemplified by the monomethylether of ethylene glycol (methyl "Cellosolve"), the monoethyl ether of ethylene glycol (ethyl ("Cellosolve"), the monopropyl ethers of ethylene glycol (propyl "Cellosolves"), the monobutyl ether of ethylene glycol (butyl "Cellosolve"), the monomethyl ether of propylene glycol, and propasol solvent ($C_3H_7$—O—$CH_2$—$CH(CH_3)OH$). Methyl "Cellosolve" is especially advantageous. Generally speaking, the boiling point, at atmospheric pressure, of said high boiling organic polar solvents is desirably not below about 210° F., and will usually fall within the range of about 230° F. to about 350° F. While such high boiling organic polar solvents can be admixed with other solvents, for instance, hydrocarbon solvents such as the xylenes, this represents a less satisfactory procedure, and therefore, in the particularly preferred embodiments of our invention the aforementioned lower alkyl monoethers of the lower glycols are utilized without the addition of other organic solvents. Of course, if desired, mixtures of two or more lower alkyl monoethers of the lower glycols can be used but, generally, no particular or significant advantages result from so doing. The amounts or proportions of the high boiling organic polar solvent utilized in the first stage of our process are not critical except that an amount is used which is at least sufficient to dissolve the sulfurized oil-soluble aliphatic hydrocarbyl-substituted phenol and, generally, somewhat of an excess thereover, for instance an approximately 5 to 15% excess thereover. In the usual case, approximately equal weights of the high boiling organic polar solvent and the sulfurized oil-soluble aliphatic hydrocarbyl-substituted phenol will be conveniently used.

The sulfurized oil-soluble aliphatic hydrocarbyl-substituted phenols which are utilized in the practice of our present invention and various methods for their preparation are well known to the art and are described in many publications and patents illustrative of which are U.S. Pat. Nos. 3,383,063; 3,746,698; 3,801,507 and 4,049,560, the disclosures of said patents in relation to said sulfurized oil-soluble aliphatic hydrocarbylsubstituted phenols and methods of preparation thereof being incorporated herein by reference. The sulfurized oil-soluble aliphatic hydrocarbyl-substituted phenols which are used as starting materials in the practice of the process of our invention are acidic and the acidity may vary appreciably although, in general, they are relatively weakly acidic. It is particularly preferred to utilize those sulfurized oil-soluble aliphatic hydrocarbyl-substituted phenols in which the aliphatic hydrocarbyl groups or radicals are alkyl containing from about 6 to 30 carbon atoms and, more particularly, alkyls having from 9 to 16 carbon atoms, or an average of about 9 to about 16 carbon atoms.

Certain of said oil-soluble aliphatic hydrocarbyl-substituted phenols, which are sulfurized for use as starting material in the practice of our invention, can, prior to sulfurization, be represented by the formula

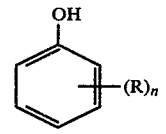

where R is a straight or branched chain, saturated or unsaturated, aliphatic hydrocarbon radical having from 6 to 30 carbon atoms, and n is an integer having a value of 1 or 2, said aliphatic hydrocarbyl phenol having a total from 8 to 40 carbon atoms in the aliphatic hydrocarbyl radicals thereof.

In the first stage of our process, it is desired to use at least an amount of magnesium oxide product which, as to the magnesium oxide content thereof, is essentially stoichiometric in relation to the acidity of the relatively weakly acidic sulfurized oil-soluble aliphatic hydrocarbyl-substituted phenols, to effect neutralization. Although it is advantageous to utilize reagent grade magnesium oxide, the more economical technical or lower grade magnesium oxide products can satisfactorily be utilized in the practice of our process. Any unreacted material which may have been present in said lower grade or technical magnesium oxide products can readily be removed by filtration or other separation procedures where indicated or desirable at any later convenient stage of the process. It is particularly advantageous, but not essential to our invention, that, in the first stage of the process of our invention, TBNs of the order of about 80 to about 85 are obtained were methyl "Cellosolve" is used as the organic solvent for the sulfurized oil-soluble aliphatic hydrocarbyl-substituted phenol. It is to be understood that all TBN values which are referred to herein, whether determined in the first or the second stages of our process, are measured after stripping off volatile organic solvents which may be present in the compositions on which the determinations are made.

From a procedural standpoint, in the first stage of the process of our invention, all that is required is that the sulfurized oil-soluble aliphatic hydrocarbyl-substituted phenol be dissolved in the methyl "Cellosolve" or other selected high boiling organic polar solvent, the magnesium oxide be added, with stirring or agitation, in amounts to effect essentially full or complete neutralization of the sulfurized oil-soluble aliphatic hydrocarbyl-substituted phenol, and that the temperature of the mixture be raised, for instance, to refluxing temperature and the mixture refluxed to produce the magnesium sulfurized aliphatic hydrocarbyl-substituted phenol. In certain instances, particularly where the magnesium oxide may not be reagent grade, a generally slight residue remains. A sediment as remains can, of course, as noted above, be removed, for instance by centrifugation, or by filtration preferably using a filter aid.

While, as stated above, the first stage of the process of our invention can be carried out in the manner indicated above, it is more desirable and advantageous that, in the first stage, there may also be included a relatively nonvolatile diluent oil, that is, one having a boiling point at atmospheric pressure above about 390° F. Such diluent oils are, more desirably, mineral oils of paraffinic, naphthenic or asphaltic base character mixtures thereof, and lubricating oils derived from coal products although, in place thereof, synthetic lubricating oils can be used such as polymers of propylene; polymers of polyoxypropylenes, synthetic hydrocarbon lubricating oils derived from $C_8$–$C_{12}$ alpha-olefins; vegetable oils such as cottonseed oil, corn oil and castor oil; animal oils such as lard oil and sperm oil; and mixture of two or more of such and other diluent oils. The nonvolatile diluent oil serves, among other things, to control the viscosity of the reaction mixture. It may, however, here by noted that, after the completion of the second stage of the process of our invention, additional nonvolatile diluent oil can be added to produce a final composition having a desired viscosity and, also, a desired concentration of the magnesium sulfurized phenates. At any rate, at the end of the first stage of the process of our invention, the magnesium sulfurized aliphatic hydrocarbyl-substituted phenols will generally have TBNs in the range of about 60 to about 90, and especially about 75 to about 85 or 90.

After the neutralization reaction of the first stage of our process is completed and prior to moving forward to the carrying out of the second stage of our process, it is possible to remove some, most or essentially all of the organic solvent, for instance, methyl "Cellosolve," by stripping by distillation and blowing the residue with an inert gas, preferably nitrogen, at elevated temperatures, for instance, about 320°–370° F., for such time, commonly, about 10 or 15 minutes. However, this represents a distinctly non-preferred procedure since the removal of the organic solvent, where such is indicated or desired, is by far most desirably effected after the carrying out of the second stage of our process.

As noted above, in the second stage of the process of our invention, the magnesium sulfurized aliphatic hydrocarbylsubstituted phenol composition obtained in the first stage of our process is reacted with the magnesium intermediate. This is carried out in a system which includes a process solvent, a promotor and, optionally, although desirably, varying proportions of an oil-soluble sulfonic acid. The oil-soluble sulfonic acids, where used, generally may range from about 1 to about 25 parts, better still from about 3 to about 8 parts, per 100 parts, by weight, of the magnesium salt of the sulfurized aliphatic hydrocarbyl-substituted phenol produced in the first stage of the process of our invention.

While the time period over which the magnesium intermediate is added to the first stage-produced composition is variable and not critical, generally speaking we find it preferable that such addition be gradual over a period of about ¼ hour to about 2½ hours, usually from about ½ hour to about 1½ to 2 hours, depending, also, on the volumes of the materials being utilized.

In those instances where an oil-soluble sulfonic acid is used, it is preferred to use it together with a volatile hydrocarbon solvent, such as heptane or hexane, in the form of, say, a hexane solution of the oil-soluble sulfonic acid. The oil-soluble sulfonic acids are well known in the art, being, generally, hydrocarbon sulfonic acids in which the hydrocarbon part of the molecule has a molecular weight in the range of about 250 to about 900, preferably in the range of about 350 to about 550. Illustrative of such oil-soluble sulfonic acids are alkylbenzenes containing either 1 or 2 alkyl radicals, or mixtures thereof, with the alkyl groups having sufficient carbon atoms, generally from about 9 to 20, preferably 12 to 16, carbon atoms to attain the aforesaid molecular weight range. Such oil-soluble sulfonic acids are disclosed in many prior U.S. Patents, typical of which is U.S. Pat. No. 3,525,599,the disclosure thereof with respect to oil-soluble sulfonic acids being incorporated herein by reference.

The process solvents which can be used can be selected from a wide group of materials among which are, illustratively, aromatic and aliphatic hydrocarbons such as benzene, toluene, xylenes, pentane, hexane, octane, and petroleum naphtha; primary aliphatic $C_1$ to $C_6$ alcohols such as methanol, ethanol, propanol, isopropanol, butanols and hexanols; and $C_3$ to $C_8$ alkoxy alkanols such as methoxyethanol, ethoxypropanol, methoxy octanol and ethoxyoctanol. The process solvents are, generally, relatively volatile and having boiling points which are advantageously below about 300° F., at atmospheric pressure, preferably below about 255° F.

Water is generally the promotor of choice in this system. However, materials having active hydrogen such as aliphatic amines and ammonia, for instance, can also be used as promoters, but are not preferred because of cost and, generally, also because numbers of them tend to leave residues which may have a somewhat undesirable effect upon the application of the final product so far as optimum results are concerned. At any rate, no patentable novelty is claimed broadly in the use of promoters since many are per se well known to the art and are disclosed in various patents.

The following Examples are illustrative, but in no way limitative, of the present invention. Other Examples will be readily apparent to those skilled in the art in light of the guiding principles and teachings disclosed herein.

The equipment used in the following examples, carried out on a laboratory scale, is a 500cc three-neck reactor equipped with a stirrer, thermometer, condenser plus take-off and an additional funnel with inert gas outlet and with a pressure equalizer bypass, said reactor being supported on a heating mantle.

The reagents employed in the carrying out of the examples are as follows, with appropriate short designations for simplicity of expression:

NPS—A sulfurized nonyl phenol, prepared by reacting nonyl phenol with $SCl_2$, in the form of a 70 wt.% solution in a diluent oil (a naphthenic mineral oil having a SSU of 150 at 100° F.), the combining weight of the NPS being approximately 235.

MC—Methyl "Cellosolve."

MgO—Magnesium oxide (J. T. Baker Co.—reagent grade).

HPN—Diluent oil (a naphthenic mineral oil having a viscosity of 80 SSU at 100° F.).

MgNPS—Magnesium salt of NPS produced in first stage of the process.

Hex-Acid—Oil-soluble branched chain alkylbenzene sulfonic acid (M.W.≅450) in the form of a 24 to 24.5 wt.% solution in hexane.

MgI—Magnesium intermediate (magnesium methylcellosolvate which has previously been carbonated and is dissolved in Methyl "Cellosolve" and contains about 7.8 wt.% Mg and about 0.95 moles of $CO_2$/mole of Mg), and about 14 wt.% $CO_2$.

EXAMPLE A

STAGE I (Preparation of MgNPS)

The example was run in duplicate—Runs Ia and Ib.

100 g NPS, 100 g MC, 5.3 g MgO, and 42 g of HPN are added to the reactor and heated, to reflux, under conditions of stirring, for 2 to 3 hours, and then the MC is stripped off and the residue heated to about 360° F. while passing a stream of nitrogen gas through the reaction mixture to remove all solvents. As noted above, this represents a distinctly non-preferred procedure, but it was done here for the purpose of isolating and analyzing the composition at the end of the first stage of the process of our invention. The following results were obtained.

| | Run Ia | Run Ib |
|---|---|---|
| Sediment | 0.1 | 0.16 |
| TBN | 89.5 | 92.1 |

The proportions of the ingredients used above in Stage I are reasonably variable. Generally, for instance, in conjunction with the use of 100 g of the NPS, the MC may range from about 80 to about 120 g; and the MgO may range from about 5.2 to about 10 g. The HPN is not essential for the process.

STAGE II (Preparation of Final Overbased Magnesium Sulfurized Phenates

Again, Stage II of the Example was run in duplicate—Runs IIa and IIb.

In Run IIa, 149 g of the MgNPS prepared in Run Ia, 50 g of heptane and 10.9 g of the Hex-Acid are placed and stirred together in the reactor at a temperature of about 90° F. The azeotropic mixture (10 g of MC and 5 g of water) and 90.4 g of magnesium intermediate dissolved in 50 g of MC are added over a 30 minute period and then the temperature is gradually raised to about 180° F. and maintained at that temperature for about 2 hours. The temperature is then gradually increased to about 330° F. while passing nitrogen gas through the reaction mixture to remove the organic solvents. A small amount of a sulfur-like material appears on the upper surfaces of the reactor during the solvent removal and stripping. The resulting overbased magnesium sulfurized phenate product has a TBN of 239.5, a sediment (Vol.%) of 2, and content of Mg of 5.52 (Wt.%).

Run IIb is carried out in the same way with the same ingredients in the same proportions except that the azeotropic mixture used was made up of 15 g of MC and 9 g of water, and the initial temperature of heating was to 135° F. instead of 90° F. The resulting overbased magnesium sulfurized phenate product has a TBN of 236, a sediment (Vol.%) of 0.3, and a content of Mg of about 5.74 (Wt.%).

The Wt.% of Mg is determined through Atomic Absorption data.

TBNs are determined in accordance with conventional procedures in regard to overbased magnesium sulfurized phenates, as referred to, for instance, in the aforementioned U.S. Pat. No. 3,746,698.

The proportions of the ingredients used above in Stage II are reasonably variable. Generally, for instance, in conjunction with the use, based on 100 g of the MgNPS, the heptane may range from about 25 to about 40 g; the Hex-Acid may range from zero to about 15 g; the MgI may range from about 60 g to about 70 g; the MC may range from about 30 g to about 40 g; in the azeotropic mixture the MC may range from about 3 g to about 9 g and the water may range from about 1 g to about 9 g; and the initial temperature to which the reaction mixture is raised may range from about 80° to about 180° F. It may, here, also be noted that, in arriving at any particular azeotropic mixture being utilized, account should be taken of such amount of water which is formed in the carrying out of the first stage of the process of our invention.

EXAMPLE B

Preparation of Overbased Magnesium Sulfurized Phenate 150 g NPS, 150 g MC, 8 g MgO, 63 g HPN, 10.9 g Hex-Acid, and 50 g heptane are added to the reactor and heated to reflux under conditions of stirring for 2 to 3 hours. After the reaction is completed, an azeotropic mixture (10 g of MC and 5 g of water) and 91 g of magnesium intermediate are added over a 30 minute period and a temperature is maintained at 180° F. for 2 hours. The temperature is gradually raise to about 330° F. while passing nitrogen through the reaction mixture to remove the organic solvents. The resulting overbased magnesium sulfurized phenate product has a TBN of 242.3, a sediment (Vol.%) of 0.5 and a content of Mg of 5.66 (Wt.%).

In those cases where it is desired that the final overbased magnesium sulfurized hydrocarbyl-substituted phenol compositions be present in the form of solutions other than a nonvolatile diluent mineral oil or vegetable or animal oil or synthetic lubricating oil as, for instance, a relatively volatile liquid hydrocarbon or other compatible liquid organic solvent, or a mixture of such nonvolatile diluents with a relatively volatile compatible and miscible liquid organic solvent, the process of our invention can readily be adjusted to produce such final compositions. This can be done by the addition of such liquid diluents and/or organic solvents during the process proper or by admixtures made after the completion of the two-stage process proper.

What is claimed is:

1. A process for preparing overbased magnesium sulfurized hydrocarbyl-substituted phenol compositions having a total base number in the range of about 200 to about 275 which comprises:

(a) providing a solution in a high boiling polar solvent in the form of a lower ($C_1$-$C_6$) alkyl monoether of a lower glycol of an acidic sulfurized aliphatic hydrocarbyl-substituted phenol in which the aliphatic hydrocarbyl phenol which is sulfurized is represented by the formula

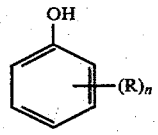

where R is a straight or branched chain, saturated or unsaturated, aliphatic hydrocarbon radical having from 6 to 30 carbon atoms, and n is an integer having a value of 1 or 2, said aliphatic hydrocarbyl phenol having a total from 8 to 40 carbon atoms in the aliphatic hydrocarbyl radicals thereof;

(b) adding to said solution, under conditions of agitation and heat to a temperature falling in the range up to about reflux temperature, magnesium oxide in an amount sufficient to effect substantially complete neutralization of the acidic sulfurized aliphatic hydrocarbyl-substituted phenols whereby to produce a magnesium sulfurized aliphatic hydrocarbyl-substituted phenol; and (c) then effecting overbasing by admixing with said neutralized admixture, in the presence of a promoter selected from the group of water, ammonia and aliphatic amines having active hydrogen, a magnesium alkoxide-carbonate complex having the following formula $$Mg(OCH_2CH_2OR)_{2-x}\ (O-\overset{O}{\overset{\|}{C}}-OCH_2-CH_2-OR)_x$$

where R is selected from the group consisting of (1) $C_1$ to $C_6$ alkyl groups and (2) an organic radical having the formula $$-\underset{H}{\overset{H}{C}}-\underset{H}{\overset{H}{C}}-O-R^1$$

where $R^1$ is a $C_1$ to $C_4$ alkyl group and where x is a number varying from 0.5 to 1.5, said complex being added in an amount to produce a final overbased magnesium sulfurized aliphatic hydrocarbyl-substituted phenol composition which, after removal of volatile organic solvent, has a total base number in the range of about 200 to 275.

2. A process for preparing overbased magnesium sulfurized aliphatic hydrocarbyl-substituted phenol compositions having a total base number in the range of about 200 to about 275 which comprises:

(a) forming a solution comprising:

(i) a solution in a high boiling polar solvent, in the form of a lower ($C_1$-$C_6$) alkyl monoether of a lower glycol, of an acidic sulfurized aliphatic hydrocarbyl-substituted phenol in which the aliphatic hydrocarbyl phenol which is sulfurized is represented by the formula

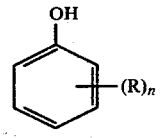

where R is a straight or branched chain, saturated or unsaturated, aliphatic hydrocarbon radical having from 6 to 30 carbon atoms, and n is an integer having a value of 1 or 2, said aliphatic hydrocarbyl phenol having a total from 8 to 40 carbon atoms in the aliphatic hydrocarbyl radicals thereof;

(b) adding to said solution, under conditions of agitation and heat to a temperature falling in the range up to about reflux temperature, magnesium oxide in an amount sufficient to effect substantially complete neutralization of the acidic sulfurized aliphatic hydrocarbyl-substituted phenol; and (c) then effecting overbasing by admixing with said neutralized admixture, in the presence of a promoter selected from the group of water, ammonia and aliphatic amines having active hydrogen, and of a volatile process solvent, a magnesium alkoxidecarbonate complex having the following formula $$Mg(OCH_2CH_2OR)_{2-x}\ (O-\overset{O}{\overset{\|}{C}}-CH_2-OCH_2OR)_x$$

where R is selected from the group consisting of (1) $C_1$ to $C_6$ alkyl groups and (2) an organic radical having the formula $$-\underset{H}{\overset{H}{C}}-\underset{H}{\overset{H}{C}}-O-R^1$$

where $R^1$ is a $C_1$ to $C_4$ alkyl group and where x is a number varying from 0.5 to 1.5, said complex being added in an amount to produce a final over-based magnesium sulfurized aliphatic hydrocarbyl-substituted phenol composition which, after removal of volatile organic solvent, has a total base number in the range of about 200 to 275.

3. The process of claim 2, in which said high boiling organic polar solvent comprises the monomethyl ether of ethylene glucol.

4. The process of claims 2 or 3, in which the promoter comprises water.

5. The process of claim 4, in which the sulfurized aliphatic hydrocarbyl-substituted phenol is predominately a mono-alkyl phenol in which alkyl contains from about 9 to about 16 carbon atoms.

6. The process of claim 1, wherein volatile organic solvents are stripped from the compositions subsequent to the carrying out of step (c).

7. A process for preparing overbased magnesium sulfurized phenates which comprises:

(a) forming a solution in monomethyl ether of ethylene glycol of an acidic sulfurized alkylphenol of which the alkylphenol is represented by the formula

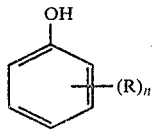

wherein R is a straight or branched chain, saturated or unsaturated, aliphatic hydrocarbon radical, having from 6 to 30 carbon atoms and n is an integer having a value of 1 or 2, said alkylphenol being characterized further in that the total number of carbon atoms is from 8 to 40, and a nonvolatile mineral oil diluent;

(b) while the temperature is in the range of about 80° to about 180° F., reacting said solution of step (a) with magnesium oxide in an amount sufficient to effect substantially complete neutralization of said acidic sulfurized alkylphenol whereby to produce a magnesium sulfurized alkylphenol; and (c) admixing with said magnesium sulfurized alkylphenol composition a magnesium alkoxide-carbonate complex containing from about 4 to about 10 wt.% of magnesium and having the following formula

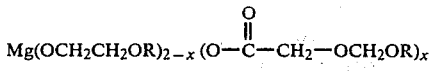

where R is selected from the group consisting of (1) $C_1$ to $C_6$ alkyl groups and (2) an organic radical having the formula

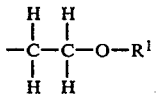

where $R^1$ is a $C_1$ to $C_4$ alkyl group and where x is a number varying from 0.5 to 1.5, said complex being added in amount to produce a final composition which, after removal of volatile organic solvent, has a total base number in the range of about 200 to about 275.

8. The process of claim 7, wherein at least most of the monomethyl ether of ethylene glycol is stripped by distillation from the compositions subsequent to the carrying out of step (c).

* * * * *